US005792278A

United States Patent [19]

Wojcik

[11] Patent Number: 5,792,278

[45] Date of Patent: Aug. 11, 1998

[54] PROCESS FOR CLEANING INKS FROM VARIOUS SURFACES INCLUDING PRINTING PLATES

[75] Inventor: Gerald Wojcik, Thomaston, Conn.

[73] Assignee: MacDermid Incorporated, Waterbury, Conn.

[21] Appl. No.: 823,806

[22] Filed: Mar. 24, 1997

Related U.S. Application Data

[63] Continuation-in-part of Ser. No. 529,598, Sep. 18, 1995, abandoned.

[51] Int. Cl.[6] ..... B08B 3/04; B08B 3/08

[52] U.S. Cl. ..... 134/38; 134/25.4; 134/40; 134/42; 510/170

[58] Field of Search ..... 134/38, 40, 42, 134/25.4; 510/170

[56] References Cited

U.S. PATENT DOCUMENTS

| | | | |
|---|---|---|---|
| 3,501,373 | 3/1970 | Illingworth | 162/5 |
| 4,780,235 | 10/1988 | Jackson | 252/170 |
| 4,836,950 | 6/1989 | Madsen et al. | 252/153 |
| 5,424,001 | 6/1995 | Bayless | 252/170 |

*Primary Examiner*—Zeinab El-Arini
*Attorney, Agent, or Firm*—John L. Cordani

[57] ABSTRACT

A method for cleaning organic residues, particularly inks, from various surfaces. The method involves contacting the surfaces to be cleaned with a composition including n-methyl-2-pyrrolidone, at least one ester alcohol, at least one unsaturated aliphatic hydrocarbon, isoparaffin and dibasic ester along with other optional ingredients.

8 Claims, No Drawings

PROCESS FOR CLEANING INKS FROM VARIOUS SURFACES INCLUDING PRINTING PLATES

This application is a continuation-in-part of Ser. No. 08/529,598 which was filed on Sep. 18, 1995 and now abandoned.

BACKGROUND OF INVENTION

The present invention relates to a relatively safe and environmentally friendly cleaning liquid for use in the graphics industry. In particular the invention relates to a liquid for cleaning ink from printing machines, printing plates, offset screens, rubber sheets and ink rollers. As such the cleaning solution of this invention is capable of replacing traditional, more volatile solvent based cleaning compositions.

Cleaning or washing printing inks from printing plates, rollers, and other machine parts within the graphics industry has been effected by means of cleaning liquids which mainly contain dangerous substances such as low boiling aromatic solvents, and as such entails considerable risks to the individuals handling these substances. In particular, the use of petroleum distillates or aromatic compounds such as xylene, toluene or naphthalene based agents is widespread. The significant health dangers of these substances is well known. Such compounds are, in general, highly volatile and exhibit low flash points.

Because of the health hazards associated with these volatile solvents, various efforts have been made to produce cleaning solutions which are free of such solvents. U.S. Pat. No. 5,104,567, (Staehr) the teachings of which are incorporated herein by reference in their entirety, reveals one such solution. Staehr proposes a solution of vegetable oil and an emulsifier as an ink cleaner. Staehr also gives a fair picture of the prior art in this field.

It is an object of the present invention to provide an ink cleaning solution which is safer to handle and more environmentally friendly than volatile solvents but which is also a more effective cleaning agent than previously taught solvent substitutes. These and other objects of this invention will be apparent to those skilled in the art after reading the disclosure contained herein.

SUMMARY OF THE INVENTION

The present invention relates to a composition and process useful in cleaning inks and ink residues from printing plates, screens, rollers and other parts of printing machines. The composition of the current invention comprises the following:

1). N-methyl-2-Pyrrolidone;
2). Ester Alcohol;
3). Unsaturated Aliphatic Hydrocarbons;
4). Isoparaffin;
5). Dibasic Ester;
6). Optionally, Alkyl Carbonate;
7). Optionally, Surfactant;
8). Optionally, Glycols;
9). Optionally, Monoester.

It has been discovered that a mixture of the above indicated materials produces an ink cleaning composition which possesses excellent cleaning properties, but is safer to handle and more environmentally friendly than previously known ink cleaning compositions.

DETAILED DESCRIPTION OF THE INVENTION

The inventor herein has discovered that a particular mixture provides excellent ink and ink residue cleaning ability with relatively safe handling and environmental effects. As such the compositions of this invention are particularly useful in the graphics industry for cleaning printing machines and parts thereof. Basically the compositions of the invention comprise:

1. N-methyl-2-Pyrrolidone;
2. Ester Alcohol;
3. Unsaturated Aliphatic Hydrocarbons;
4. Isoparaffin;
5. Dibasic Ester;
6. Optionally, Alkyl Carbonate;
7. Optionally, Surfactants;
8. Optionally, Glycols;
9. Optionally, Monoester.

N-Methyl-2-Pyrrolidone is a heterocyclic lactam having no active hydrogen. It is available from Rhone-Polanc Company. The concentration of N-methyl-2-Pyrrolidone in the cleaning composition is preferably from 5 to 25 percent by weight.

The ester alcohol can be any ester which has an alcohol functionality. It is preferable that the ester alcohol have a molecular weight of 200 or greater and it is also preferable that the ester alcohol have a stable neopentyl structure. An example of a preferred ester alcohol is Texanol, which is available from the Texaco Company. Texanol is a trade name for 2,2,4-trimethyl-1,3-pentanediol mono (2-methylpropanoate). The concentration of the ester alcohol in the cleaning composition is preferably from 5 to 25 percent by weight.

The unsaturated aliphatic hydrocarbons can themselves be a single compound or a mixture of unsaturated aliphatic hydrocarbons. One such preferred unsaturated aliphatic hydrocarbon is the NeoSolv line of unsaturated aliphatic hydrocarbons available from the Shell Company. Any one or a combination of these Neo Solvs is suitable. The general structure of the NeoSolv products is $CH_3(CH_2)_xCH{=}CH_2$ where x is an integer of from 5 to 20. Two particularly preferred Neo Solvs are NeoSolv (4) and NeoSolv (6). NeoSolv (4) is 1-Tetradecene $[CH_3(CH_2)_{11}CH{=}CH_2]$ and NeoSolv (6) is 1-Hexadecene $[CH_3(CH_2)_{14}CH{=}CH_2]$. The concentration of the unsaturated aliphatic hydrocarbons in the cleaning composition is preferably between 5 and 35 percent by weight.

Isoparaffin is an odorless solvent which has a low level of skin irritation and is widely used in food related applications. The concentration of isoparaffin in the cleaning composition is preferably between 1 and 10 percent by weight.

Dibasic ester is a material of commerce sold by the Dupont Company or the Monsanto Company. The concentration of dibasic ester in the cleaning composition is preferably between 5 and 25 percent by weight.

The alkyl carbonate is preferably an ethoxylated carbonate or propoxylated carbonate such as dipropylene carbonate or propylene carbonate. The concentration of alkyl carbonate in the cleaning composition is preferably between 2 and 20 percent by weight.

Optionally surfactants or emulsifiers may be added to the cleaning composition. Preferably the surfactants (emulsifiers) used are non-ionic. If used, the concentration of the surfactants (emulsifiers) in the cleaning composition is preferably between 0.5 and 10 percent by weight. It may also be preferable to employ a mixture of surfactants (emulsifiers) depending upon the particular application of the cleaning composition. The addition of surfactants (emulsifiers) is particularly useful if it is important to make the cleaning composition water rinseable and, in fact, when surfactants (emulsifiers) are used very little to no residue remains after a simple water rinse.

It is also optionally preferable to include a glycol or mixture of glycols in the cleaning composition. The inventor has found dipropylene glycol to be particularly useful in this regard. If used, the concentration of glycol in the cleaning composition is preferably between 2 and 10 percent by weight.

Optionally, and preferably a monoester may be included in the formulation. Preferably the monoester has at least nine carbons within its structure. Preferable monoesters are the Exxates, which are available from the Exxon Chemical Company. The Exxates are alkyl esters of the following formula:

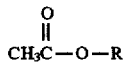

where R is a functional group of the formula $C_xH_{2x+1}$ and is preferably:

| | |
|---|---|
| Exxate 600 | $R = C_6H_{13}$ |
| Exxate 700 | $R = C_7H_{15}$ |
| Exxate 800 | $R = C_8H_{17}$ |
| Exxate 900 | $R = C_9H_{19}$ |
| Exxate 1000 | $R = C_{10}H_{21}$ |
| Exxate 1300 | $R = C_{13}H_7$ |

The R group may be straight chain or branched. Exxate 1000 is a particularly preferred monoester.

The concentration of the monoester in the cleaning composition is preferably between 5 and 35 percent by weight.

As indicated the cleaning composition of this invention is particularly useful in cleaning ink, ink residues and other organic residues from printing apparatus. This cleaning composition effectively cleans and removes a variety of inks and ink residues including heat set, U.V. and offset type inks and residues. These compositions are also useful in cleaning a variety of surfaces.

This invention is further described by the following examples which are meant to further describe particular embodiments of the invention but are not meant to be limiting:

EXAMPLE I

A cleaning solution was prepared according to the following formulation:

| | % by weight |
|---|---|
| N-methyl-2-Pyrrolidone | 15.0 |
| Dipropylene Glycol | 6.0 |
| Texanol[1] | 10.0 |
| Exxate 1000[2] | 20.0 |
| NeoSolv (4)[3] | 20.0 |
| Dibasic Ester | 15.0 |
| Propylene Carbonate | 8.0 |
| Isoparaffin | 6.0 |

[1]Available from Texaco Company
[2]Available from Exxon Company
[3]Available from Shell Company The above indicated formulation was then utilized to clean various types of inks, ink residues, and other organic residues from various surfaces including metal, rubber, plastic and ceramic. The results were excellent, meaning that the composition effectively cleaned the surfaces without damage to the surfaces.

EXAMPLE II

A cleaning solution was prepared by adding 30 grams per liter of Triton X-100 (available from the Rhom & Hass Company) to the formulation given in example I. The resulting cleaning composition was water rinseable and left very little to no residue after rinsing.

This formulation was then utilized to clean various types of inks, ink residues and other organic residues from various surfaces including metal, rubber, plastic and ceramic. The results were excellent meaning that the composition effectively cleaned the surfaces without damage to the surfaces.

EXAMPLE III

A cleaning solution was prepared according to the following formulation:

| | % by Weight |
|---|---|
| N-methyl-2-Pyrrolidone | 25.0 |
| Texanol | 20.0 |
| NeoSolv(6) | 25.0 |
| Isoparaffin | 5.0 |
| Dibasic Ester | 15.0 |
| Propylene Carbonate | 10.0 |

The above indicated formulation was then utilized to clean inks, residues, and other organic residues from various surfaces including metal, rubber, plastic and ceramic. The results were excellent, meaning that the composition effectively cleaned the surfaces without damage to the surfaces.

EXAMPLE IV

A cleaning solution was prepared according to the following formulation:

| | % by Weight |
|---|---|
| N-methyl-2-Pyrrolidone | 15.0 |
| Texanol | 20.0 |
| NeoSolv(6) | 25.0 |
| Isoparaffin | 5.0 |
| Dibasic Ester | 15.0 |
| Propylene Carbonate | 10.0 |
| Exxate 1000 | 10.0 |

The above indicated formulation was then utilized to clean various types of inks, ink residues and other organic residues from various surfaces including metal, rubber, plastic and ceramic. The results were excellent, meaning that the composition effectively cleaned the surfaces without damage to the surfaces.

EXAMPLE V

A cleaning solution was prepared according to the following formulation:

| | % by Weight |
|---|---|
| N-methyl-2-Pyrrolidone | 25.0 |
| Texanol | 25.0 |
| NeoSolv(4) | 25.0 |
| Isoparaffin | 10.0 |
| Dibasic Ester | 15.0 |

The above indicated formulation was then utilized to clean various types of inks, ink residues and other organic residues from various surfaces including metal, rubber, plastic and ceramic. The results were excellent, meaning that the composition effectively cleaned the surfaces without damage to the surfaces.

What is claimed is:

1. A process for cleaning organic residues from a substrate, said process comprising contacting the substrate with a composition comprising:

a. N-methyl-2-pyrrolidone b. 2,2,4-trimethyl-1,3, pentanediol mono(2-methyl propanoate)

c. an unsaturated aliphatic hydrocarbon of the structure, $CH_3(CH_2)_xCH{=}CH_2$ where x is an integer of from 5 to 20;

d. isoparaffin; and e. dibasic ester.

2. A process according to claim 1 wherein the organic residues are selected from the group consisting of inks and ink residues.

3. A process according to claim 1 wherein the substrate is selected from a group consisting of printing apparatus, rollers and screens.

4. A process according to claim 1 wherein the composition additionally comprises an alkyl carbonate.

5. A process according to claim 4 wherein the composition additionally comprises a compound selected from the group consisting of surfactants and emulsifiers.

6. A process according to claim 5 wherein the composition additionally comprises a glycol.

7. A process according to claim 6 wherein the composition additionally comprises a monoester of the following structure:

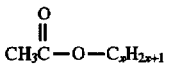

and where x is an integer of from 2 to 20.

8. A process according to claim 7 wherein the unsaturated aliphatic hydrocarbon is between 5 and 35 percent by weight of the composition.

* * * * *